United States Patent [19]

Usui

[11] 4,409,776

[45] Oct. 18, 1983

[54] METHOD AND APPARATUS FOR PACKING ARTICLES WITH COMPOSITE STRETCHED FILMS

[75] Inventor: Akira Usui, Kakegawa, Japan

[73] Assignee: Shinwa Kagaku Kogyo Kabushiki Kaisha, Tokyo, Japan

[21] Appl. No.: 279,212

[22] Filed: Jun. 30, 1981

[30] Foreign Application Priority Data

Dec. 13, 1980 [JP] Japan ..... 55-176261

[51] Int. Cl.[3] ..... B65B 11/04

[52] U.S. Cl. ..... 53/399; 53/441; 53/449; 53/465; 53/556; 53/587; 53/176; 53/211; 493/112

[58] Field of Search ..... 53/399, 441, 449, 465, 53/556, 587, 588, 210, 211, 176; 156/187, 195; 493/112, 299, 303; 242/DIG. 2

[56] References Cited

U.S. PATENT DOCUMENTS

| | | | |
|---|---|---|---|
| 1,398,569 | 11/1921 | Peterson | 53/466 X |
| 3,863,425 | 2/1975 | Edwards | 53/211 |
| 4,077,179 | 3/1978 | Lancaster | 53/441 |
| 4,081,302 | 3/1978 | Drosthorm | 156/195 X |
| 4,209,961 | 7/1980 | Donnelly | 53/556 X |

*Primary Examiner*—John Sipos

*Attorney, Agent, or Firm*—Wenderoth, Lind & Ponack

[57] ABSTRACT

A composite stretched film having one surface adhesive, while the other nonadhesive is wrapped spirally or helically about an article to be packed to form first and second superposed layers. After forming a first layer, the composite film is inverted so that the first and second layers are bonded together with their adhesive surfaces, while the nonadhesive surface of the first layer is brought to contact with the article and the nonadhesive surface of the second layer is faced outward.

12 Claims, 8 Drawing Figures

METHOD AND APPARATUS FOR PACKING ARTICLES WITH COMPOSITE STRETCHED FILMS

BACKGROUND OF THE INVENTION

This invention relates to a method and apparatus for packing articles or goods with a composite stretched film and, more particularly, to a method and apparatus for packing goods stacked on a pallet by wrapping a composite film while mechanically elongating the same.

There are two types of stretchable films, one comprising an adhesive single layer film, and the other comprising a nonadhesive single layer film, and these two types are selectively used depending upon transportation conditions, shape and weight of the goods. The term "adhesive film" is used herein to mean a film made of adhesive thermoplastic resin such as an ethylenevinyl acetate copolymer, 1,2-polybutadiene and a styrenebutadiene copolymer. When applied with a slight pressure with a hand two superposed films readily bond together. The term "nonadhesive film" is used herein to mean a film made of a resin having no adhesive property, for example, crystallized polyolefine resins such as polyethylene, polypropylene and an ethylene-propylene copolymer.

Where these films are used for packing goods on a pallet, the adhesive film has the following advantages over the nonadhesive film.

1. When the film is wrapped a number of times, because films of respective layers bond with each other, an integral cylindrical body is obtained having improved breakage strength, tension strength and binding force.
2. Since films bond together at overlapped portions, where a goods having an irregular surface are packed with the film, the film will be intimately positioned against surface of the goods thus forming a compact package.
3. The end of the film can readily be secured to the goods by merely applying a small pressure with a hand without requiring a heat seal, tape application or use of a bonding agent.

However, the adhesive film has the following disadvantages.

1. While being stored over a long time or during transportation (especially in the case of exported goods), the films of different goods bond together (blocking phenomenon) so that the films are broken when separating or unloading the goods.
2. The blocking phenomenon makes difficult such handlings as piling up, and transfer of the goods with a fork lift or a crane.
3. The adhesiveness imparting agent tends to precipitate on the surface of the film (bleeding phenomenon) thus contaminating the surface of the goods.
4. Where the film is used to pack an assembly of light weight articles having smooth surfaces, for example glass bottles and aluminum cans, because the film directly bonds to the surfaces of the articles, at the time of removing the film, bottles or cans are bonded to the film resulting in the collapse of the assembly thus making it difficult to handle the articles. Thus, the adhesive film, now being used, has advantages and disadvantages pointed out hereinabove.

SUMMARY OF THE INVENTION

It is an object of this invention to provide an improved method and apparatus for packing an article with a composite stretched film, one surface thereof being adhesive, the other being nonadhesive, in a manner such that both inside and outside surfaces of the applied layer are nonadhesive so that it is not only easy to remove the layer from the article but also blocking of packed articles can be efficiently prevented during storage and transportation.

Another object of this invention is to provide apparatus capable of accomplishing the object just described by merely adding simple coil inverting means for coil supporting means.

Still another object of this invention is to provide apparatus capable of readily adjusting the degree of stretching of the composite film, and hence the binding force of the applied layer.

According to one aspect of this invention there is provided a method of packing an article comprising the steps of preparing a composite stretchable film, one surface thereof being adhesive, the other surface being nonadhesive; wrapping the composite film under tension or a stretched state about the article to form a first layer with the nonadhesive surface in contact with the article; inverting the composite stretchable film; and wrapping the composite film about the first layer with the nonadhesive surface faced outward.

According to another aspect of this invention there is provided apparatus for packing an article with a stretched composite film, one surface thereof being adhesive, whereas the other surface is nonadhesive, comprising means for supporting an article to be packed with stretched composite film; a base plate for carrying a supporting frame which supports a coil of unstretched composite film; means for applying a tension to the composite film when it is payed out from the coil thus stretching the composite film; means for inverting the supporting frame; and means for relatively revolving the supporting means and the base plate for wrapping stretched composite film about the article to form first and second layers.

Where the width of the composite film is much smaller than the length of the article, the supporting frame is moved along the article together with the inverting means so as to helically wrap the composite film about the article with side edges of adjacent turns overlapped.

DESCRIPTION OF THE PREFERRED EMBODIMENT

A preferred embodiment of the apparatus embodying the invention will firstly be described.

Figure 1:
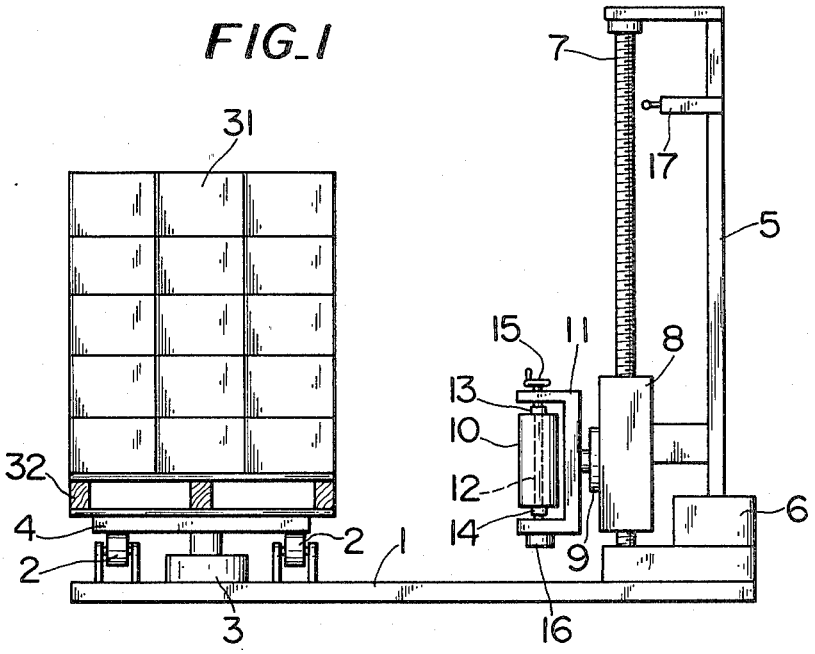
FIG. 1 is a side view showing apparatus for practicing the method of this invention.

As shown in FIG. 1, on one side of a base plate 1 is mounted a rotary table 4 rotated by an electric motor 3 and supported by a plurality of rollers 2. A vertical rotary threaded shaft 7 is provided on the other side of the base plate 1 and rotated by an electric motor 6 on the base plate. An operating member 8 is threaded onto the threaded shaft 7 to be moved in the vertical direction but prevented from rotating. A U-shaped supporting frame 11 is mounted on the front surface of the operating member 8 on an inverting device 9, for supporting a roll of a stretchable composite film 10. The reversing device composes mounting means for the coil supporting frame 11 to allow rotation of the supporting frame about an axis parallel to the longitudinal axis of the film. The purpose of the inverting device 9 is to invert the composite film 10. Clamps 13 and 14 adapted to support a core tube 12 about which the film 10 is wrapped are mounted on the upper and lower portions of the supporting frame 11. The upper clamp 13 is moved in the vertical direction by rotating a handle 15, whereas the lower clamp 14 is provided with brake means 16 for applying a braking force to the film 10 while it is payed out thus stretching the same. A limit switch 17 is adjustably supported by the upper end of a post 5 for determining the upper limit position of the operating member 8.

The method of packing will now be described. A pallet 32 supporting a stack of goods 31 is placed on the rotary table 4 using a fork lift or the like, and the roll of a stretchable composite film 10 is mounted on the supporting frame 11 with its nonadhesive surface faced toward the goods 31. Then the lower end of the operating member 8 is aligned with the upper surface of the rotary table 4 (see FIG. 1). Then the leading end of the film is bound or bonded to the pallet 32 or to the lower end of the stacked goods 31.

Figure 2:
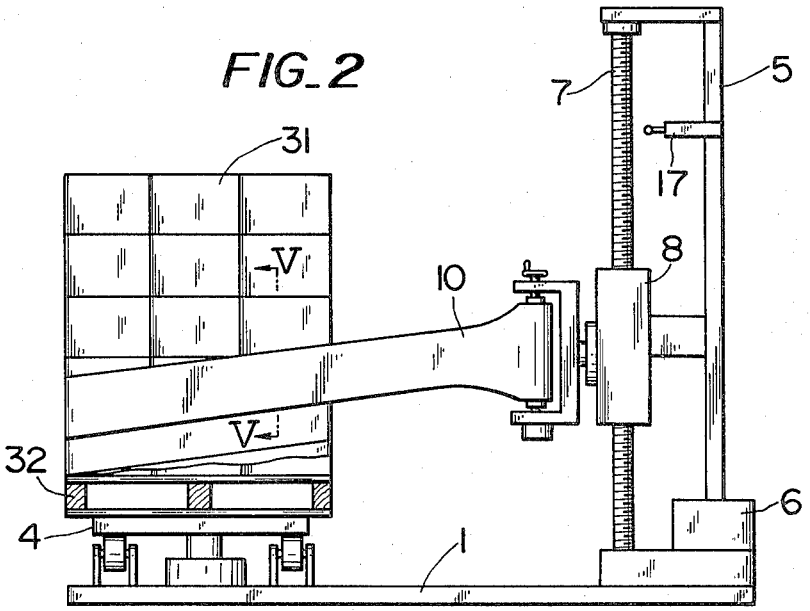
FIGS. 2 to 4 are similar views for explaining the method of packing a stack of goods supported on a pallet.
Figure 5:
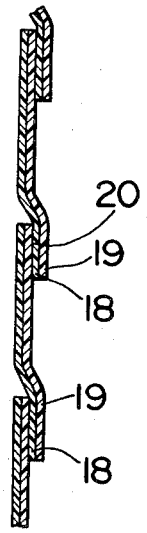
FIG. 5 is a sectional view taken along a line V—V shown in FIG. 2.
Figure 6:
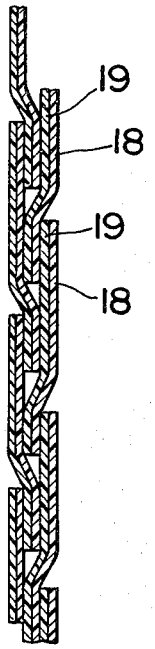
FIG. 6 is a sectional view taken along a line VI—VI shown in FIG. 4.

After completing the preparatory operations described above, the rotary table 4 is started to pay out or unwind the film 10 from the roll to which is applied a braking force by the braking means 16. The braking force stretches the film about 10 to 35% and the film thus stretched is wrapped about the side surfaces of the pallet 32 and goods 31 stacked thereon. Where acute projections or irregularities are present on the peripheries of the goods and pallet, the first one half turn or the first turn is wrapped without applied tension. Concurrently with the rotation of the pallet 32, the threaded shaft 7 is also rotated, so that the operating member 8 is moved upwardly along the post 5 with the result that the stretched film 10 is wrapped helically about the stacked goods towards the top with one side edge of a turn overlapped on one side edge of the adjacent turn (see FIG. 2). As shown in FIG. 5, the stretched film 10 is wrapped with its nonadhesive surface 18 facing inside while its adhesive surface 19 faces outside so that at the overlapped portion 20 adhesive surface 19 of one turn is bonded to the nonadhesive surface 18 of the adjacent turn. The degree of overlapping is adjusted by the number of revolutions of the rotary table 4 and the rise speed of the operating member 8 but usually, the degree of overlapping is selected to lie in a range of 1/5 and ½ of the width of the film. The operating member 8 is stopped when it engages with a limit switch 17 preset to the height of the stacked goods 31. At the same time, rotation of the rotary table 4 is also stopped.

Figure 3:
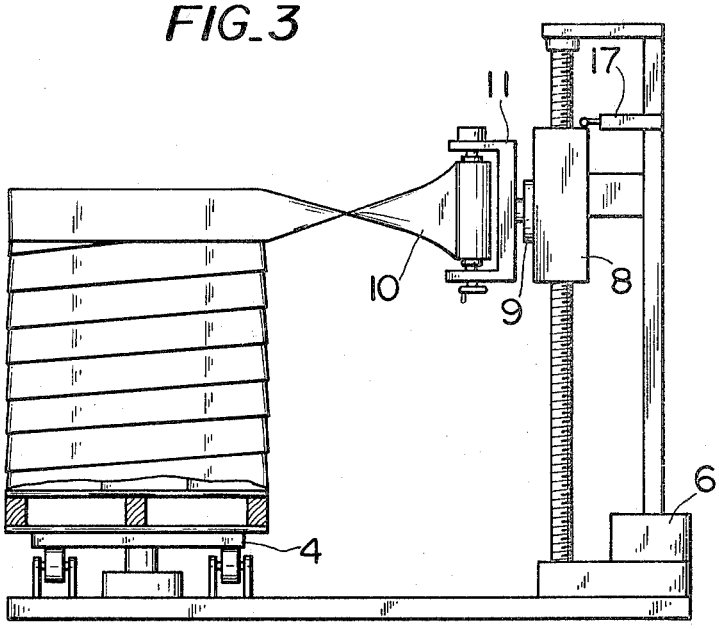

Then, the supporting frame 11 is inverted (i.e., rotated 180°) by the inverting device 9 while a tension is applied to the film 10 by the brake means 16, thus reversing the film so as to cause the nonadhesive surface 18 to face the outside as shown in FIG. 3.

Figure 4:
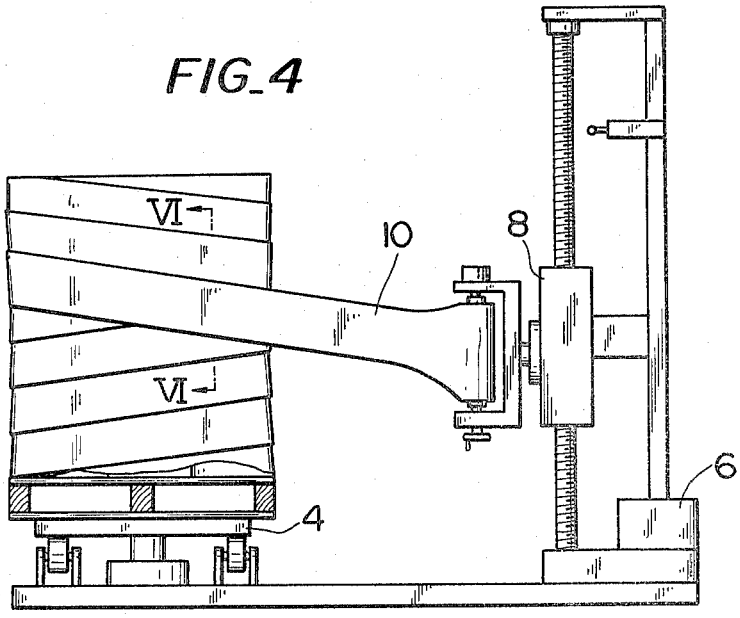

Thereafter, the rotary table 4 is rotated again and the direction of the motor 6 for driving the operating member 8 is reversed to lower the operating member 8 as shown in FIG. 4. Although the stretched film 10 is wrapped on the previously formed layer since the adhesive surface 19 which was on the outside during the upward movement of the operating member 8 is now reversed to face inside, the adhesive faces 19 of the first and second layers face each other thus firmly bonding the film layers into an integral structure.

When the operating member 8 reaches the height of start, the rotary table 4 is stopped to terminate the wrapping operation. At this time, while maintaining the stretched film under tension, a light pressure is applied to the film by a hand of an operator or a hammer to ensure accurate bonding. Then the end of the film is severed with a knife to separate the film from the stacked goods. After the separation, the braking means 16 is released and the supporting frame 11 is inverted for preparing the next cycle.

Figure 7:
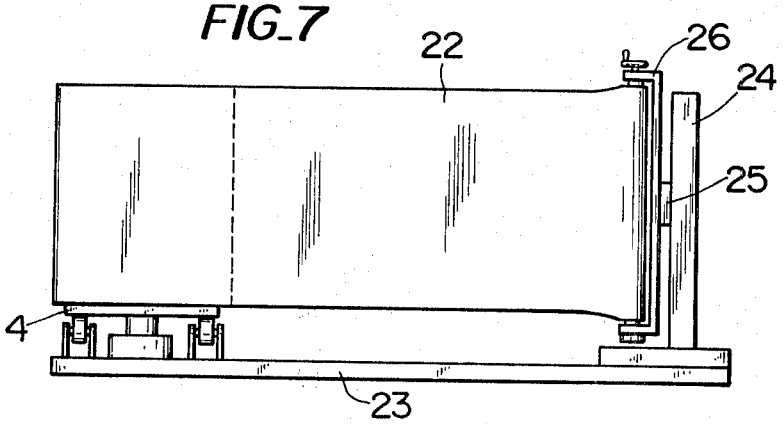
FIGS. 7 and 8 are side views showing modified embodiments of this invention.

In the modified embodiment shown in FIG. 7, a stretched film 22 having the same width as the goods to be packed is used. Thus, a roll of a stretchable film of a large width is supported by a supporting frame 26, which in turn is supported by a vertical post 24 or an inverting device 25. In this embodiment, the film 22 is wrapped many turns about an article or stacked goods and the inversion of the film is made one turn before the end. This embodiment is different from that shown in FIG. 1 in that it is not provided with the vertically reciprocating operating member.

Figure 8:
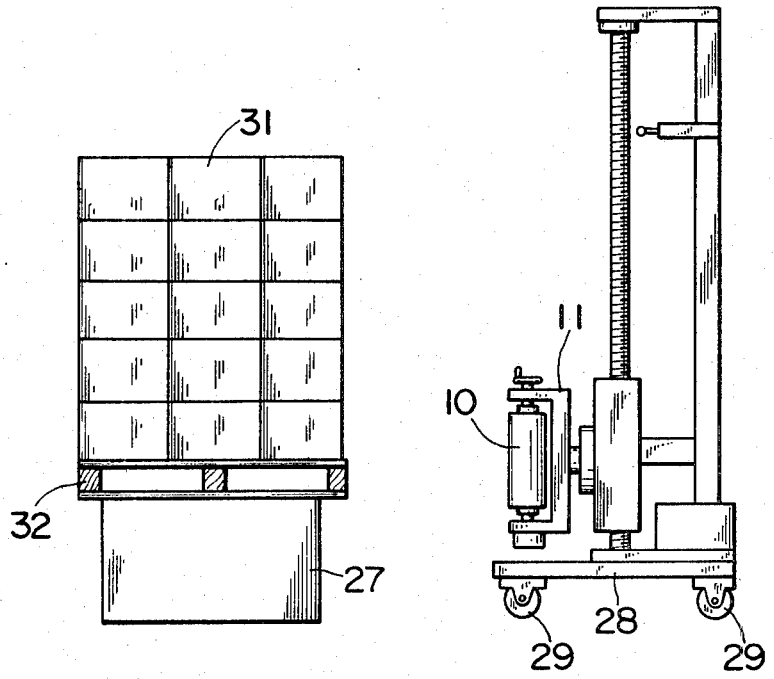

FIG. 8 shows yet another modification of this invention which is different from the first embodiment in that the pallet 32 and the goods 31 stacked thereon are held stationary, whereas the film 10 and the mechanism associated therewith are rotated to wrap the film about the goods. Thus, a pallet 32 carrying stacked goods 31 is mounted on a stationary table 27, and battery motor driven castors 29 are secured to the lower surface of a base plate 28 which supports the film supporting frame 11 and other elements identical to those shown in FIG. 1 so as to revolve the assembly about the central axis of the stacked goods 31. With this modified apparatus too, the stretched film is wrapped about the stacked goods in the same manner as in the first embodiment. Also in this embodiment, a wide film having the same width as the height of the stacked goods can be used in the same manner as that shown in FIG. 2.

Summarizing the above, the invention has the following advantages.

1. Since a composite stretched film is substituted for a single layer stretched film, and at first the film is wrapped about the goods with its nonadhesive surface faced to the goods and then the film is reversed and wrapped on the previously formed layer with the nonadhesive surface faced outward, the adhesive faces of the first and second layers face with each other, thus increasing breakage strength, tension strength and binding force over a package wound with two or more layers of a simple adhesive film. Further, since the end of the film can be secured by merely applying a small pressure, the packing operation can be automated. Since the nonadhesive surface of the film is brought into contact with the periphery of the goods, there is no trouble of bonding the film to the goods or bleeding phenomenon of the adhesion enhancing agent which contaminates the surface of the goods. Furthermore, as the nonadhesive surface of the film is also brought to the outside of the package, it is possible to prevent blocking phenomenon of the packages during storage or transportation thereof. This also eliminates breakage of the package when it is opened.

2. When forming a multilayered cover, as the composite stretched film is reversed, a single type composite film is sufficient instead of using two types of films, one adhesive, and the other nonadhesive.
3. Any prior art film packing apparatus, which may be of the fixed film type or of the film revolving type, can be used for carrying out the method of this invention by merely adding a film inverting device.
4. Where one end of a film or sheet made of a thermoplastic resin and used for covering the package is secured between the last first and second turns, it is possible to protect the package against water, moisture and dust.

What is claimed is:

1. A method of packing an article comprising the steps of:

feeding a continuous composite stretchable film web having a longitudinal axis parallel to its feeding direction from a supply roll, one surface of said web being adhesive, while the other surface being nonadhesive;

wrapping said composite film web under tension or in a stretched state about said article to form a first layer with the nonadhesive surface in contact with said article;

inverting said supply roll to thereby twist said film web about an axis parallel to said longitudinal axis so that the adhesive surface faces the article; and wrapping said inverted composite film web about said first layer with said adhesive surface in contact with said first layer, and cutting said film web wrapped around the article from the supply roll.

2. The method according to claim 1 wherein the tension is applied to said composite film by a braking force applied to said supply roll of said film.

3. The method according to claim 1 or 2 wherein said composite film is stretched about from 10 to 35%.

4. The method according to claim 1 wherein said first and second layers are formed by helically wrapping said composite film about said article with side edges of adjacent turns overlapped, said composite film having a width smaller than the length of said article.

5. The method according to claim 1 wherein said first and second layers are formed by spirally wrapping said composite film about said article, said composite film having a width nearly equal to the length of said article.

6. Apparatus for packing an article with a stretched composite film, one surface thereof being adhesive and the other surface being nonadhesive, comprising:

means for supporting an article to be packed with stretched composite film;

a base plate adjacent said supporting means and carrying a supporting frame which supports an unwindable coil of unstretched continuous composite film web having a longitudinal axis parallel to its unwinding direction from said coil;

means for applying a tension to said composite film when it is payed out from said coil for stretching said composite film;

means for relatively revolving said supporting means and said base plate for feeding and wrapping stretched composite film about said article to form first and second layers; and means for mounting said support frame for rotation about an axis parallel to said longitudinal axis of the film web so that after said first layer is wrapped around the article with the non-adhesive side contacting the article the support frame of said film web coil is inverted by rotation about said axis and said second layer is wrapped around the article with the adhesive side contacting said first layer.

7. The apparatus according to claim 6 wherein said means for supporting said article comprises a rotary table and drive means for rotating said rotary table, and said base plate is stationary.

8. The apparatus according to claim 6 wherein said means for supporting said article is fixed, and said base plate is revolvable about said article.

9. The apparatus according to claim 6, 7 or 8 wherein said composite film has a width smaller than the length of said article, and said apparatus further comprises an operating member for moving said supporting frame along the length of said article for helically wrapping stretched composite film about said article with side edges of adjacent turns overlapped.

10. The apparatus according to claim 9 wherein said means for inverting said supporting frame is interposed between said operating means and said supporting frame.

11. The apparatus according to claim 6 which further comprises braking means for applying a braking force to said composite film when the same is payed out from said coil for stretching the composite film.

12. The apparatus according to claim 11 wherein said braking means comprises a variable speed driving motor for varying the extent of stretching of said stretchable composite film.

* * * * *